United States Patent [19]

Sherby et al.

[11] 3,951,697

[45] Apr. 20, 1976

[54] SUPERPLASTIC ULTRA HIGH CARBON STEEL

[75] Inventors: Oleg D. Sherby, Palo Alto; Conrad M. Young, Del Mar; Bruno Walser, Stanford; Eldon M. Cady, Jr., Concord, all of Calif.

[73] Assignee: The Board of Trustees of Leland Stanford Junior University, Stanford, Calif.

[22] Filed: Feb. 24, 1975

[21] Appl. No.: 552,245

[52] U.S. Cl. ..... 148/12 R; 148/12 C; 148/36

[51] Int. Cl.[2] ..... C21D 7/14; C21D 9/48

[58] Field of Search ..... 148/12 R, 12 C, 36

[56] References Cited

UNITED STATES PATENTS

| | | | |
|---|---|---|---|
| 3,723,194 | 3/1973 | Hultgren et al. | 148/12 C |
| 3,857,741 | 12/1974 | Hultgren et al. | 148/36 |

OTHER PUBLICATIONS

Kaibyshev et al.; Metal Science and Heat Treatment of Metals; "Superplasticity of Steel Kh 18 N 10 T", pp. 340–341, Apr., 1973.

*Primary Examiner*—W. Stallard

*Attorney, Agent, or Firm*—Flehr, Hohbach, Test, Albritton & Herbert

[57] ABSTRACT

An ultra high carbon steel with a fine grained iron matrix stabilized by cementite in predominantly spheroidized form at elevated temperatures. A method for treating the steel including heat treatment and mechanical working under sufficient deformation to refine the iron grain and spheroidize the cementite. Mechanical working is preferably performed either in the upper alpha-cementite range or in the gamma-cementite range. Thermal cycling may be substituted for mechanical working. An alternative method is mixing and sintering fine cementite containing-iron alloy powders and iron powders.

20 Claims, 12 Drawing Figures

SUPERPLASTIC ULTRA HIGH CARBON STEEL

BACKGROUND OF THE INVENTION

The present invention relates to an ultra high carbon steel composition. It is known that conventional steel has a coarse grain size on the order of 50–100 microns. It is also known that steel having a very fine grained iron matrix is characterized by superplastic flow at elevated temperatures. However, fine grained iron tends to be unstable and grow at elevated temperatures. Thus, stabilization of the small grain size at such temperatures is necessary in order to prevent the destruction of such exceptional plasticity.

One attempt at stabilizing fine grained iron structure is set forth in an article by Morrison, entitled "Superplastic Behavior of Low-Alloy Steels", Transactions, ASM, Vol. 61, 1968, 423. That paper suggests the addition of manganese or phosphorus to the steel to increase its plasticity at elevated temperatures by stabilizing the fine grains. There are many disadvantages to this approach. The paper recites a temperature range of 850° ± 25°C for the desired plastic flow, which is too narrow a range for working temperatures on an industrial scale. Furthermore, phosphorus and manganese are relatively expensive. Another deficiency of the Morrison technique is its disclosure of the further addition of relatively expensive aluminum and vanadium to retain the fine grain size. The latter element is very expensive. Finally, the steels disclosed in the Morrison paper in Table 6 at page 433 have relatively poor cold temperature properties.

The possibility of superplastic behavior of steels similar to those of the Morrison article is disclosed in a paper by Schadler entitled "The Stress-Strain Rate Behavior of a Manganese Steel in a Temperature Range of the Ferrite-Austenite Transformation", Transactions, AIME, Vol. 242, 1968, 1281. Schadler found superplastic behavior with iron containing 1.9 weight percent manganese in the temperature range where ferrite and austenite phases coexist. He concluded that superplasticity could only be achieved at commercially unattractive strain rates (e.g., 0.1 %/minute). A further disadvantage, set forth with respect to the Morrison publication, is the narrow temperature range over which superplasticity can be expected to exist. Another commercial problem is the requirement for the addition of relatively expensive manganese.

Another approach is illustrated in a paper by Marder, entitled "The Effect of Carbon Content, Test Temperature, and Strain Rate on the Strain-Rate Sensitivity of Fe-C Alloys", Transactions of the Metallurgical Society of AIME, Vol. 245, June, 1969, 1337. There, the properties of iron-carbon alloys of high purity were studied in a composition range from 0.2 to 1.0 % carbon. The maximum elongation for the 0.8 % carbon content is 98 %. The article expresses concern with void formation at the boundary between the iron-cementite interface causing premature failure during deformation. It also suggests that cementite is brittle at warm temperatures. FIG. 5 of the paper illustrates a decrease in the strain rate sensitivity exponent, m, when the carbon content is increased from 0.8 % to 1.0 % carbon. The paper suggests the reason for this decrease is that the ferrite grains are no longer equiaxed at the higher carbon content. Thus, the paper teaches away from further increasing the carbon content.

Another attempt at a superplastic steel is set forth in a paper by Yoder et al., entitled "Superplasticity in Eutectoid Steel", Metallurgical Transactions, Vol. 3, March 1972, 675. There a worked commercial eutectoid steel was found to exhibit good ductility in a temperature range (710°–720°C) which is too narrow for use in industrial forming operations. This indicates a grain growth above that temperature range but does not offer any suggestions on a technique for expanding this range. Another deficiency of this reference is that maximum elongation is 133 %, far below superplastic behavior. Furthermore, there is no disclosure of room temperature strength.

A steel which is capable of very large deformation over a wide range of temperatures during fabrication to large strains without cracking and under all externally applied forces for minimum expenditure of energy is desirable. Furthermore, such steel should be characterized as strong, tough and possessing of high ductility for final use. A third important feature which is desirable in steel is of course that it be inexpensive. Ultra high carbon steels, i.e., with a carbon content in excess of 1.0 %, have not been considered capable of accomplishing all of these criteria. This is perhaps because they are normally considered as potentially too brittle for ambient temperature application. Furthermore, their high temperature characteristics have apparently not been explored.

SUMMARY OF THE INVENTION AND OBJECTS

It is an object of the present invention to provide an economical ultra high carbon steel which is characterized by superplasticity at elevated temperatures.

It is another object of the invention to provide an ultra high carbon steel of the foregoing type of high strength, toughness, high ductility, and combinations of these properties at cold temperatures.

Other objects and objectives of the invention will be apparent by reference to the present specification taken in conjunction with the appended drawings.

In accordance with the above objects, an ultra high carbon steel is formed of a microstructure with a stabilized iron matrix with equiaxed fine grain iron. The present invention is predicated upon the discovery that the fine grain iron of such steel compositions is stabilized at elevated temperatures by the presence of cementite (e.g., 5 volume percent or more) in predominantly spheroidized form at such temperatures. The "predominant" portion of cementite in spheroidized form is in excess of 70 percent.

A steel having the foregoing characteristics is prepared by heating at a temperature of a least 500°C and then mechanically working the steel under sufficient strain deformation (e.g., total strain on the order of $\epsilon = 1.5$) to refine the grain size and spheroidize the predominant portion of the cementite. An additional optional step is homogenization and mechanical working of the steel in the gamma range at a temperature on the order of 1100°– 1150°C wherein essentially all of the carbon is dissolved in the austenite matrix at carbon contents below 2.0% (Parts expressed in terms of parts by weight unless otherwise specified).

Mechanical working is preferably carried out at elevated temperatures from the lower limits of conventional warm working (e.g., 500°C) to a temperature low in the gamma-cementite range, say, as high as 900°C. If all mechanical working occurs at a temperature above the gamma-alpha transition line, the cementite which is spheroidized at the higher temperatures will remain as cementite at room temperature but the gamma grains will transform (e.g., to pearlite). Subsequent heating to a temperature above this transition line is required to render this material superplastic. On the other hand, if sufficient mechanical working is performed to refine the iron grain and spheroidize the cementite at a temperature in the alpha-cementite range, the cementite is stable in such form when cooled to room temperature. This material is superplastic at the lower end of the warm working range. For example, this temperature may be as low as 150°C below the transition line.

A number of differing techniques set forth hereinafter may be employed to accomplish the formation of the fine iron grain and spheroidized cementite. For example, the steel may be tempered at say, 700°C, and thereafter mechanically worked at a cold temperature. To prevent cracking, such cold working to the desired iron grain size should be performed in steps with intermittent tempering.

In another technique, steel heated to a temperature in excess of the alpha-gamma transformation line is quenched to form martensite, a fine structure. Such martensite is then tempered and mechanically worked. This procedure is advantageous in that the martensite formation assists spheroidization and fine grain formation. Also, the final product has the desired combined properties of the extremely high strength of fine particle-hardened alpha iron at ambient temperature and of excellent plasticity for working at elevated temperatures.

In a different technique, a product of the desired microstructure may be formed by powder metallurgy. For example, fine (e.g., 1–10 microns) iron powder can be mixed in appropriate proportions with white cast iron (4 – 5% carbon) of the same size and pressed and sintered at warm temperatures to form the final product.

DETAILED DESCRIPTION OF THE PREFERRED EMBODIMENTS

Figure 1:
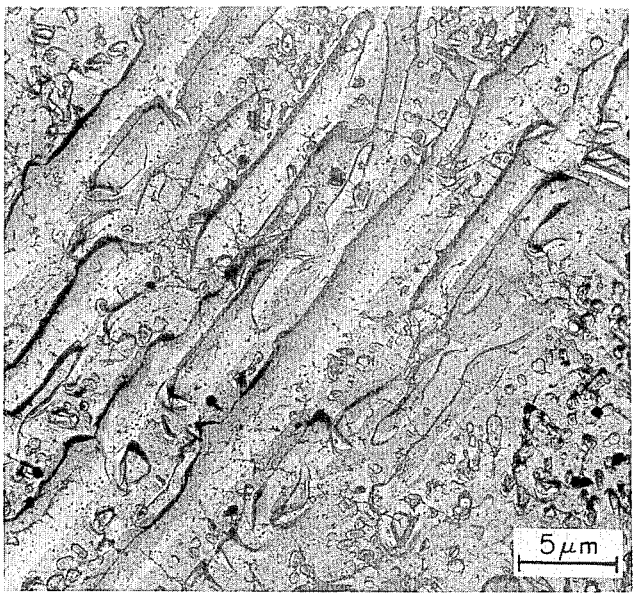
FIGS. 1 – 3 are electron photomicrographs of as-cast ultra high carbon steels.

In general, the ultra high carbon steel, defined above, used in the present process is formed by conventional alloying techniques of carbon addition in the molten state prior to casting. Thereafter, the steel is treated to form a microstructure of exceptional plasticity and even superplasticity at elevated temperatures and with strength, toughness and ductility at cold temperatures. The microstructure includes an iron grain matrix with uniformly dispersed cementite. The iron grain is in a predominantly (e.g., greater that 70%) equiaxed fine grained configuration.

"Steel" is defined herein as an iron-base alloy containing manganese, typically on the order of 0.4% – 0.5%, and other impurities, e.g., 0.1 to 0.2% silicon. "Ultra high carbon" is defined as a steel with a carbon content substantially in excess of the eutectoid composition (0.8%), i.e., 1.0% to possibly as high as 4.3%. A typical carbon range is on the order of 1.0% to 2.3% and preferably 1.3% to 1.9%. The term "fine grained" will be used herein to describe iron having an average grain size no greater than about 10 microns, typically about 1.5 microns or less.

As set forth above, it is known that the tendency for superplastic deformation diminishes with an increase in grain size but that iron grain grows rapidly at elevated temperatures. It has been discovered that the fine grained structure is stabilized at elevated temperatures by the presence of cementite ($Fe_3C$) in predominantly spheroidized form. The absolute content of cementite in the structure may be determined from the carbon content by reference to the phase diagram. For convenience, the approximate relationship in the alpha-cementite range is as follows:

$$15.4 \times \text{weight \% carbon content} = \text{volume \% cementite content}$$

For clarity of description, the methods for forming the ultra high carbon steel of the present invention will be set forth prior to a more detailed description of the steel. Briefly described, the ultra high carbon steel is heat treated at a temperature of at least 500°C and thereafter mechanically worked under sufficient strain deformation to convert the iron to fine grain form and to convert the cementite into predominantly spheroidized form (e.g., in excess of 70% spheroidized).

First Method

In a "first method" for forming the ultra high carbon steel of the present invention, a steel plate, billet, or any other form of steel, is first homogenized in the gamma range by heating to a temperature at which substantially all of the carbon present in the cementite is dissolved in the austenite (gamma iron) matrix. A suitable temperature for this purpose is on the order of 1100° to 1150°C. By reference to the iron-carbon phase diagram, it is apparent that with a carbon content in substantial excess of 2%, the carbon content is too high to be completely dissolved in the austenite. As defined herein, homogenization will include heating a steel with a carbon content in excess of 2% to a temperature high in the gamma-cementite range (e.g., 50°C below the melting point of 1147°C). The purpose of homogenization is to place the carbon and other elements present into a relatively uniform solution. This assists in the formation of a uniform fine grained iron structure after working.

In a second step according to the first method, the steel plate is then mechanically worked in the gamma range to break up the cast structure. This is an optional step. As defined herein, mechanical working includes rolling, forging, extrusion, or any other procedure which subjects the steel to sufficient deformation to form the aforementioned microstructure. The purpose of mechanical working in the gamma range is to accelerate homogenization and refine the austenite grains which might otherwise tend to grow and form larger grain structure. This may reduce the requirement for subsequent mechanical working to accomplish the desired fine grained structure with spheroidized cementite.

In the next step, the steel plate is mechanically worked to a substantial extent during cooling through the gamma-cementite range. It is preferable that such working be continuous. This working comminutes the pro-eutectoid cementite into a finer spheroidized form as it is precipitated from solution. Mechanical working also contributes to further refining the austenite grain.

The level of mechanical working varies depending upon a number of factors including the prior processing history of the steel. A typical amount of deformation in the gamma-cementite range is a true strain level ($\epsilon$) on the order of 1.5. A practical measure of such strain is the deformation produced during a size reduction of a 5:1 ratio.

In a final step of the first method, the casting is again mechanically worked, as by rolling, at a temperature high in the ferrite-cementite range. Strains of the foregoing order of magnitude are employed at this temperature not only to spheroidize further the cementite structure but also to break up the pearlite structure formed during the gamma-alpha transition. Temperature employed for such mechanical working is on the order of 500° to 720°C. At the lower end of the range the steel can possibly alligator. Accordingly, it is preferable that this mechanical working take place above this temperature as in a range from 600° to 720°C.

A steel formed in accordance with the foregoing process includes an iron grain matrix with uniformly dispersed cementite. The iron grain is stabilized in a predominantly equiaxed fine grained configuration. The cementite is in predominantly spheroidized form at cold to elevated temperatures. For economy of operation and uniformity of the microstructure, it is preferable to mechanically work the steel continuously from temperatures in the gamma-cementite range through temperatures high in the alpha-cementite range.

In a "first alternative method", the mechanical working in the alpha-cementite range is eliminated so that the primary mechanical working is in the gamma-cementite range. The results of this procedure is as follows. During mechanical working in the gamma-cementite range, essentially all of the pro-eutectoid cementite is converted to the spheroidized form. However, during transformation of the iron from the gamma to the alpha form on cooling, a portion of the austenite containing dissolved carbon is converted to ferrite plus additional cementite in non-spheroidized form, typically plates. As set forth above, it is important that essentially all of the cementite be in spheroidized form at the temperature of fabrication in order for the steel to be highly plastic at that temperature. Accordingly, at temperatures below the gamma-alpha transformation (723°C) the presence of substantial non-spheroidized cementite reduces the plasticity of the steel processed in accordance with this alternative procedure. However, by heating the steel to a temperature above the alpha-gamma transition (723°C) most of the non-spheroidized cementite and all of the alpha iron is reconverted to austenite iron containing dissolved carbon with a large portion of the remaining cementite in spheroidized form. This material is again rendered superplastic.

The first alternative method is to be contrasted to the first method in which the steel is mechanically worked in the alpha-cementite range. In the first method, essentially all of the cementite which is present in the steel in the alpha-cementite range is converted to spheroidized form. That steel is superplastic at typical temperature of fabrication on either side of the gamma-alpha conversion (e.g., 600°–900°C).

Second Method

In a "second method" the steel is treated in a manner similar to the first method including homogenization in the gamma range and mechanical working in the gamma-cementite range. The details of these procedures are incorporated at this point by reference. Thereafter, at a temperature low in the gamma-cementite range (e.g., 750°–850°C), the steel plate is rolled isothermally to form a fine grained iron. Since this steel is highly plastic at such temperature, it can be worked extensively without cracking. Thereafter, the steel may be processed according to conventional techniques. For example, the rolled casting can be air cooled to room temperature for storage. The microstructure of this rolled steel includes fine pearlite with speroidized cementite. Isothermal working at 800°C has the advantage that refining of the iron grains and cementite as well as spheroidizing of the cementite occurs at a controlled and fixed temperature and can yield a strong, tough material. Since this material has a fine structure at room temperature, it can be reheated at a subsequent time to temperatures at which it can be fabricated into the desired configuration in a superplastic state. A preferred temperature for such final working is low in the gamma-cementite range. This heating across the gamma-alpha transition removes the non-spheroidized cementite which had precipitated in plate form during cooling. The different microstructure formed by working in the alpha-cementite and gamma-cementite range are set forth in the section on the first method.

The steel, isothermally worked in the gamma plus cementite range, is made superplastic below 723°C by deforming it to large strains (e.g., $\epsilon$=1.5) in the alpha plus cementite range (e.g., 600° to 700°C). As stated in the first method this deformation process will spheroidize the transformation product obtained from cooling the steel previously worked isothermally in the gamma-cementite range.

Third Method

In a "third method," the ultra high carbon steel is heated into the gamma range for homogenization in accordance with the principles of the foregoing first and second methods. Here, the steel is rapid cooled through the alpha-gamma transformation to form martensite plus retained austenite. Thereafter, the steel is tempered to a suitable temperature high in the alpha-cementite range, e.g., 650°C. As a last step, this tempered martensite containing steel is warm worked in the alpha-cementite range to break up and spheroidize the cementite precipitated from the retained austenite. As a precaution against cracking, the quenching rate should be controlled. One technique is to employ an oil quench rather than a water quench for this purpose.

The third method may have a number of advantages. Firstly, the formation of martensite creates a relatively fine microstructure which thus reduces the amount of working required to refine the grain size. In addition, the final product is extremely strong at room temperature and is characterized by superplasticity at temperature at 600°–900°C which can be employed for fabrication. The structure of this steel at room temperature includes fine grained iron and cementite in predominantly spheroidized form.

In an alternative to the third method, mechanical working may be accomplished in the gamma-cementite range rather than warm working in the alpha-cementite range. For high plasticity, fabrication of a steel produced according to this alternative is accomplished in the gamma-cementite range.

Fourth Method

In a "fourth method" total mechanical working takes place at cold temperatures. It employs part of the procedure of the third method. Thus, the ultra high carbon steel plates are homogenized in the gamma range and then guenched. These plates are then tempered under conditions to obtain an annealed product. Suitable conditions for annealing are temperatures high in the alpha-cementite range, e.g., 700°C, for a time on the order of one-half hour to 2 hours. This annealed product is cooled to room temperature. Then, the product is mechanically worked, as by rolling, to impose a part of the deformation required to spheroidize essentially all of the cementite and refine the grain size to the desired extent in the subsequent annealing treatment. It is preferable not to impose the total amount of deformation required for this purpose in a single cold rolling because of the possibility of cracking at room temperature. After the first step, the steel is reheated and annealed suitably at the foregoing conditions in order to cause recovery and refinement of the structure. Then this cycle is repeated until the desired total strain is applied.

Thermal cycling through the gamma-alpha transformation temperature at say, 600°–800°C, will accelerate the recovery process. In an alternative to the fourth method, the steel may be annealed low in the gamma-cementite range followed by slow cooling (e.g., air cooling) to room temperature. This material can be cold rolled to impart part of the total deformation. Thereafter, this cycle of annealing and cold working is repeated several times until the desired total deformation is accomplished.

It is apparent that both the fourth method and the alternative fourth method require longer times and more careful control than the first, second and third methods. Thus, in general, the first three methods are preferable ones.

Fifth Method

In a "fifth method", a steel billet is first homogenized in the gamma range and mechanically worked in the same range to break up the cast structure. As set forth in the section on the first method, mechanical working in the gamma range is optional. It accomplishes acceleration of material homogenization and so may be referred to as "mechanical homogenization".

After mechanical working in the gamma range, the cast structure is cooled directly to a warm temperture in the alpha-cementite range and mechanically worked at this temperature to form a fine structure of spheroidized cementite in a fine grained iron matrix. In essence, this procedure accomplishes the total deformation required for this purpose in the alpha-cementite range rather than in a combination of gamma-cementite and alpha-cementite range as set forth in the first and second methods. Suitable warm working temperatures in the alpha range are from a minimum of 500°C to the transformation temperature (723°C) and preferably at least 600°C.

In an alternative to the fifth method, mechanical working may be accomplished in the gamma-cementite range rather than warm working in the alpha-cementite range. For optimum plasticity, fabrication of a steel produced according to this alternative is accomplished in the gamma-cementite range.

General Discussion

The carbon content of the final ultra high carbon steel is selected within ranges determined by the desired properties of the final product. As set forth above, it has been found that the carbon content must be in excess of that present in eutectoid steel (0.8%) and at least 1.0% to produce the desired properties of exceptional plasticity at warm temperature and room temperature strength, toughness, and ductility. As set forth above, 1.0% carbon corresponds to a cementite content at room temperature of 15.4 volume percent. In contrast, a eutectoid steel (carbon content 0.8%) with a cementite content of 12.3 volume percent produces a product with a significantly lower plasticity at elevated temperatures. As set forth below, ultra high carbon steels with a carbon content between 1.3% and 1.9% have produced excellent superplastic properties when processed as set forth above. A suitable maximum carbon content may be as high as about 2.0 to 2.3% or more but less than 4.3%.

Steels of the foregoing type are generally characterized by superplasticity at the indicated temperature ranges.

The term "superplastic" as used in the present specification may be defined by reference to the following formula:

$$\sigma = K\dot{\epsilon}^m, \text{ wherein}$$

$\sigma$ is the flow stress,
$\dot{\epsilon}$ is the strain rate,
$K$ is a material constant, and
$m$ is the strain rate sensitivity exponent.

A superplastic steel is one in which the exponent $m$ is on the order of 0.35–0.40 or greater and which includes elongations on the order of at least 200 to 300% and as high as 400 to 500% or more. This property is often times measured at a rate of deformation of about $10^{-5}$ sec$^{-1}$. Steel containing 1.3% to 1.9% carbon of the foregoing microstructure exhibiting an $m$ value on the order of 0.4, and elongations in excess of 400% and approaching 500% when tested high in the ferrite-cementite range (650°C, T equals $0.5T_m$) at deformation rates of 1–10%/min. or more. Such elongations were accomplished in tests performed at strain rates as high as 10% per minute. By way of comparison, conventional steel has an $m$ value of 0.20 and elongations substantially below 100%. It is generally believed that perfect superplastic behavior is associated with an $m$ value of 0.5, but superplasticity herein is defined as a practical value less than this.

The temperature range of superplasticity of the ultra high carbon steel of the present invention may range from 500° to 950°C. Above this temperature, the iron grain has a tendency to grow. A optimum temperature for superplasticity is 600°C to 800°C, preferably toward the higher end of the range.

The ultra high carbon steel of the present invention is characterized by excellent characteristics at room temperature in comparison to conventional plain carbon steels. For example, it includes yield strength of at least 80–100 ksi, tensile strength of at least 100–125 ksi, and a tensile elongation of as high as 4 to 15% or more. It is believed that these characteristics are attributable to the presence of the cementite in spheroidized form. In a specific example, a 1.3% steel, warm worked at a temperature of 565°C was characterized by a yield strength of about 195 ksi, an ultimate tensile strength of 215 ksi, and a 4% tensile elongation. The ductility of this material was improved by annealing with a resultant decrease in the yield strength. For example, after annealing for 100 hours at 500°C, the product had a yield strength of 150 ksi and a ductility of 15% (uniform) elongation. This latter material is very tough.

It is believed that for superplastic behavior of two phase metallic systems, the relative strength of each of the two phases should be approximately the same at the temperature range where superplastic flow is to occur. Since the ultra high carbon steels of the present invention exhibit superplasticity ($m \approx 0.5$) in the gamma-cementite range at 800°C, it is assumed that the cementite and iron are approximately equal in strength at this temperature. Thus, the temperature range of superplasticity can be determined by reference to relative strength of these two phases.

It is further believed that the presence of manganese and other impurities (e.g., silicon) at the levels common to commercial steels assist the spheroidized cementite in maintaining the fine grain size of the iron and thus its superplastic properties.

Other techniques may be employed to form the ultra high carbon steel of the foregoing invention so long as the desired microstructure is obtained. One possible technique is to accomplish the desired deformation by thermal cycling between temperatures across the alpha-gamma transformation. It would be necessary to repeat this cycling many times because each stage of such temperature deformation is relatively small compared to that accomplished by mechanical working.

Another technique which may be employed to form a steel of the desired microstructure is powder metallurgical mixing of powders of iron alloys containing spheroidized cementite and fine iron powders. For example, fine powders (e.g., 1–10 micron size) of white cast iron (4 to 5% carbon can be mixed with iron powders of approximately the same size and pressed and sintered at 600°–700°C to bond the powders by solid state diffusion. The proportions are selected to conform to the foregoing total carbon contents. Commercial steel impurities including manganese may be supplied in the iron alloy or iron component. The final product has a microstructure with superplastic characteristics at elevated temperatures.

Treatment of ultra high carbon steels by the foregoing techniques can also be employed for steels with the same carbon content and additional alloying elements for their known properties. For example, greater control of the rate of transformation is possible with a 1.5% Cr steel than with plain high carbon steels. This, in turn, will permit greater flexibility in obtaining a desired final microstructure. Although the properties of such steel alloys may be varied over a wide range, they are more expensive. Such alloys are deemed to form a part of the present invention.

In order to disclose more clearly the nature of the present invention, specific examples of the practice of the invention are hereinafter given. It should be understood that this is done by way of example and is not intended to limit the scope of the invention. All FIGS. (1–12) are electron photomicrographs taken at the indicated magnification.

EXAMPLE 1

An example of the thermal mechanical processing of the first method is as follows.

A casting of the 1.3%C steel was heated to 1130°C for 60 minutes and then was rolled continuously, in fifteen passes, at 15% per pass, to a true strain to 2.0. Since the original casting cooled during rolling it experienced deformation in the gamma range as well as gamma plus cementite range. When a temperature of 565°C was reached it was rolled isothermally in this ferrite plus cementite range to an additional true strain of 0.8 (again, at 10% per pass). The microstructure of the warm worked steel, given in FIG. 4, reveals a fine spheroidized structure with ferrite grains in the order of one micron and less. The room temperature properties of the material were as follows: (1) the Rockwell "C" hardness of the plate was 46, and (2) tensile tests revealed a yield strength of 195 ksi, an ultimate tensile strength of 215 ksi and tensile elongation of 4.2% (one inch gage length sample). The high temperature properties reveal this material to be superplastic with 480% elongation to fracture at 650°C when deformed at a strain rate of one percent per minute.

Figure 2:
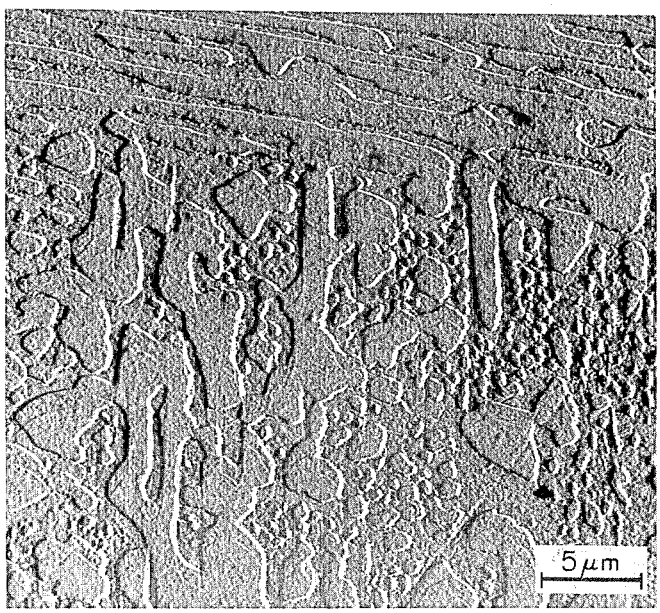
Figure 3:
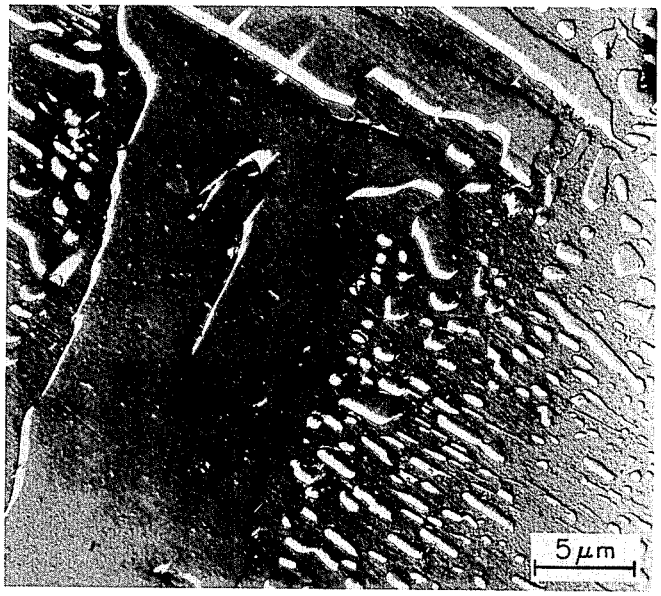

FIGS. 1, 2 and 3 illustrate as-cast steel structures prior to processing according to the present invention. FIG. 1 is a 1.3% carbon steel at 3200× magnification. FIGS. 2 and 3 are 1.6% and 1.9% carbon steels, respectively, both at 3200× magnification.

Figure 4:
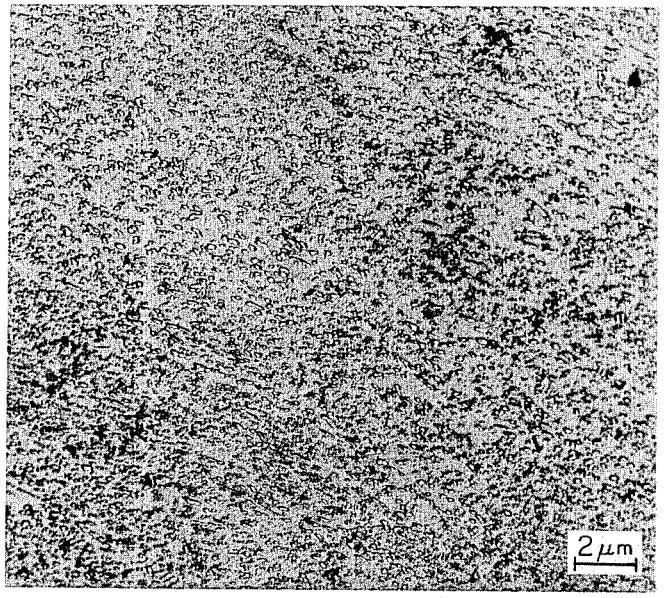
FIGS. 4 – 12 are electron photomicrographs of various ultra high carbon steels according to the present invention.
Figure 5:
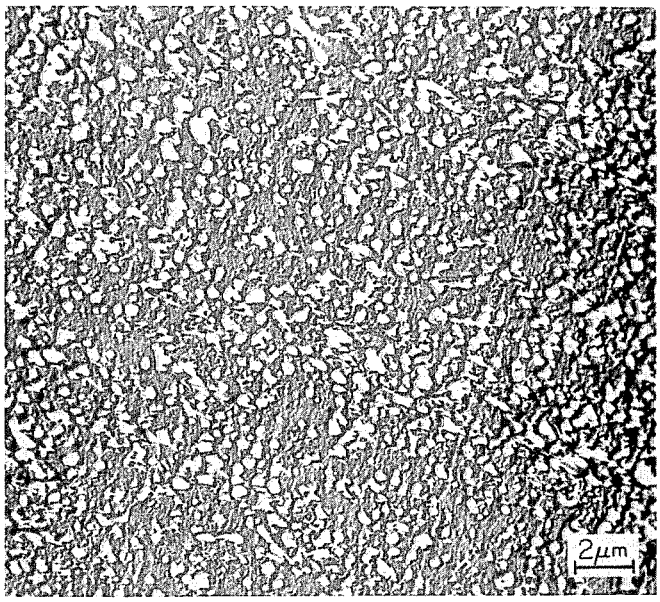
Figure 6:
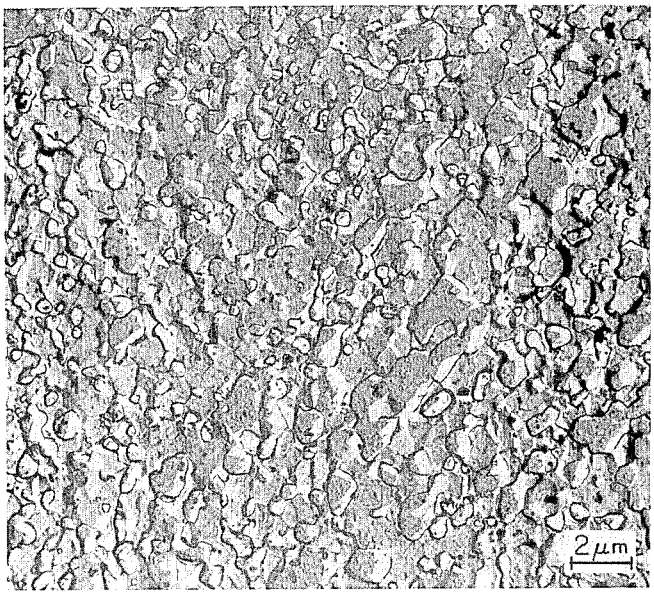

In contrast, FIG. 4 is a 1.3% carbon steel at 4600× magnification processed in accordance with Example 1 illustrating a fine spheroidized microstructure. Similarly, FIGS. 5 and 6 are 1.6% and 1.9% carbon steels at 4600× magnification processed generally according to Example 1 also illustrating fine grained spheroidized microstructure.

Figure 7:
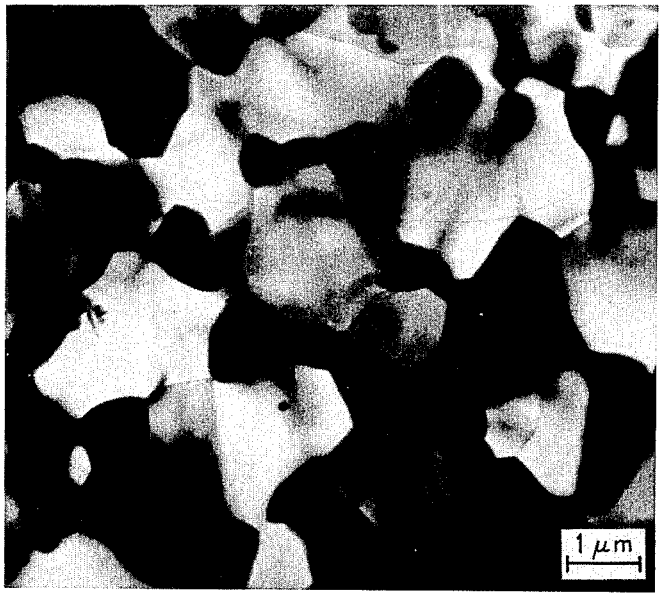

FIG. 7 illustrates a 1.9% carbon steel treated in accordance with Example 1 and then subjected to 100% elongation in a tensile test at 650°C. This figure shows a "bulbous" shape of the cementite (dark color) which is typical of superplastic microstructure. The magnification of this micrograph is 12,300×.

EXAMPLE 2

Figure 8:
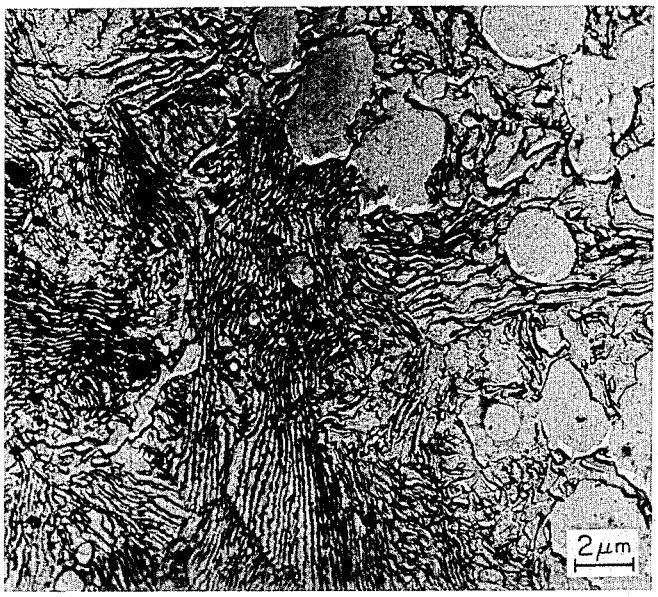

An example of processing according to the second method is as follows. A 1.6 carbon casting was homogenized at 1100°C for 60 minutes. It was then forged in the gamma plus cementite range (cooling to about 800°C), in ten steps, to a total true strain of 2.0. The forged plate was then rolled isothermally at 850°C to a total true strain of 2.0 (at twenty percent per pass with 5 minutes reheating time between passes) and then air cooled. The microstructure of this steel is shown in the electron photomicrograph of FIG. 8 (4600× magnification). FIG. 8 illustrates the presence of proeutectoid cementite in spheroidized form and a transformation product consisting of fine pearlite. The room temperature properties of this material gave a Rockwell C hardness of 30. In compression tests at room temperature, the plate exhibited a yield strength of 190 ksi, with no cracking occurring up to 30% compression strain.

Figure 9:
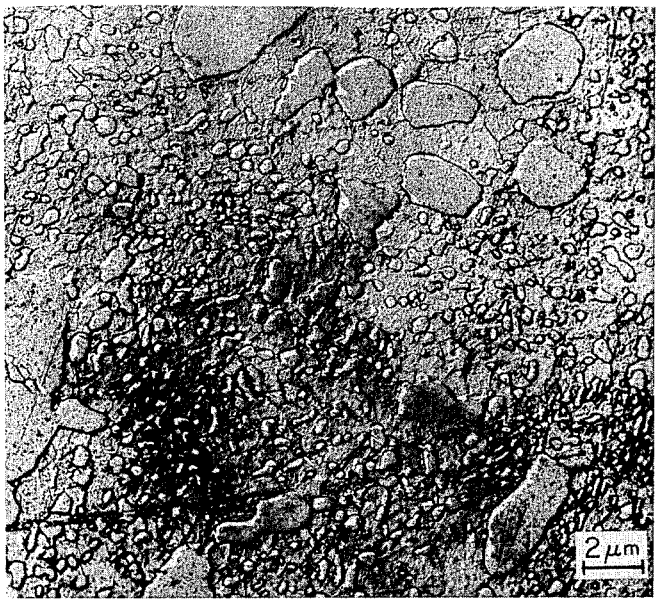

If the above processed steel is heated to 650°C and isothermally worked at this temperature to a true strain of $\epsilon = 1.2$, the result is a microstructure as shown in FIG. 9 (4600× magnification). Much of the transformation product is now spheroidized and the result is a strong material with a room temperature hardness of Rockwell C 37.

EXAMPLE 3

Figure 10:
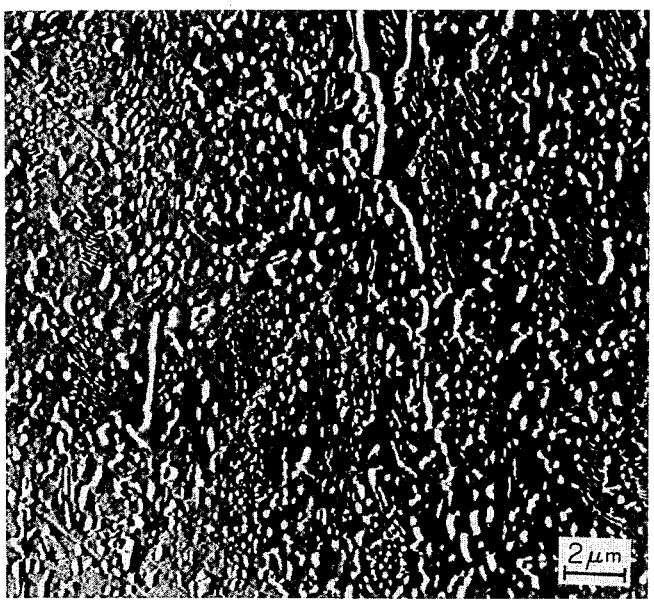

An example of treating a 1.6% carbon steel by the third method is as follows. The casting was homogenized at 1130°C for 60 minutes and water quenched. It was then heated to 550°C for 2 hours and rolled isothermally at this temperature to a strain of 1.8. The fineness of the spheroidized structure obtained at the low warm working temperature resulted in a high room temperature hardness of Rockwell C 50. FIG. 10 is an electron photomicrograph (4600× magnification) of a 1.6% carbon steel process according to Example 3. A fine spheroidized microstructure is noted.

EXAMPLE 4

Figure 11:
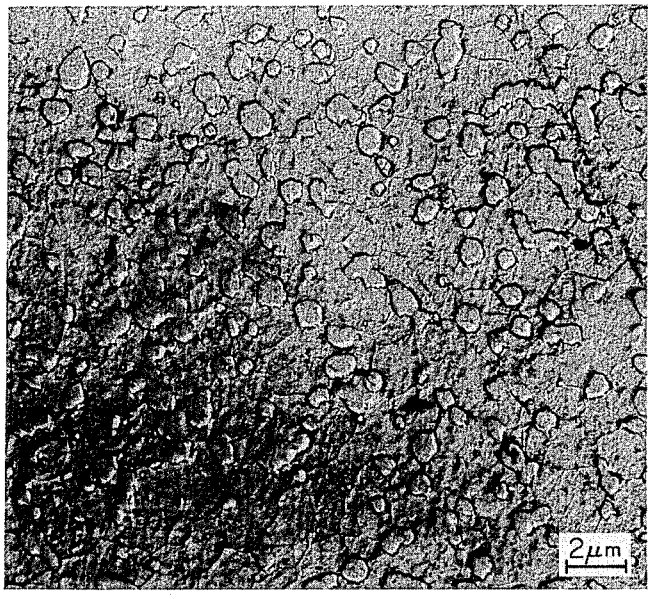

An example of treating a 1.3% carbon steel by the fourth method is as follows. The original casting was heated to 1100°C for 90 minutes and subsequently quenched in water. It was then annealed at 700°C for 45 minutes, air cooled and cold rolled to a strain of 0.3. It was again annealed at 700°C for 30 minutes, air cooled and further rolled at room temperature to an additional strain of 0.5. A final annealing treatment at 700°C for 30 minutes was given in order to recover the cold worked structure. FIG. 11 (4600× magnification) illustrates the fine structure obtained by this cyclic annealing, cold-working and annealing treatment of the 1.3% carbon steel quenched from the gamma range. This material is relatively soft (Rockwell C 20) because of the high annealing temperature after the last cold rolling operation.

EXAMPLE 5

Figure 12:
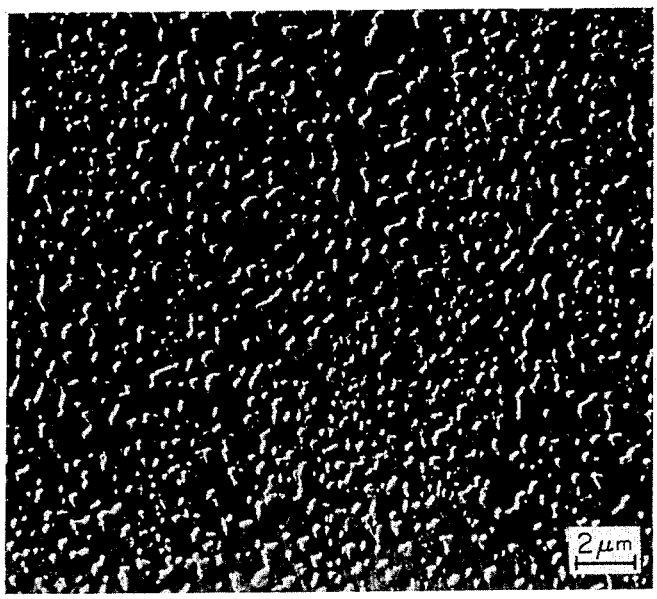

An example of treating a 1.6% carbon steel by the fifth method is as follows. The original casting was homogenized at 1130°C for 60 minutes and worked at this temperature to a true strain of 1.0. It was then cooled and worked isothermally at 565°C to a true strain of 1.5. The resulting microstructure (at 4600×) is shown in FIG. 12 where it can be readily seen that a very fine spheroidized structure was obtained. Its room temperature hardness was Rockwell C 48. After annealing the rolled product at 650°C for 30 minutes, its room temperature hardness decreased to Rockwell C 37. The yield strength of the annealed product was 166 ksi with a total elongation of 3%.

What is claimed is:

1. An ultra high carbon steel having a carbon content in excess of about 1.0% and an iron grain matrix with uniformly dispersed cementite, said iron grain being stabilized in a predominantly equiaxed configuration having an average grain size no greater than about 10 microns, said cementite being in predominantly spheroidized form in a temperature range of 723°C to 900°C.

2. An ultra high carbon steel as in claim 1 characterized by superplasticity in the temperature range of 723°C to 900°C.

3. An ultra high carbon steel as in claim 1 having a maximum carbon content of 2.3%.

4. An ultra high carbon steel as in claim 1 in which said carbon content comprises 1.3% to 1.9% of the steel.

5. An ultra high carbon steel as in claim 1 characterized by a yield strength of at least 80 ksi at room temperature.

6. An ultra high carbon steel as in claim 1 characterized by tensile strength of at least 100 ksi at room temperature.

7. An ultra high carbon steel as in claim 1 having a tensile elongation of at least 4.0%.

8. An ultra high carbon steel as in claim 1 in which the iron is predominantly in martensite form at room temperature.

9. An ultra high carbon steel having a carbon content in excess of about 1.0% and an iron grain matrix with uniformly distributed cementite, said iron grain being stabilized in a predominantly equiaxed configuration having an average grain size no greater than about 10 microns, said cementite being in predominantly spheroidized form at room temperature.

10. An ultra high carbon steel as in claim 9 characterized by superplasticity in a temperature range of 600°C to 900°C.

11. In a method for treating an ultra high carbon steel having a carbon content of at least 1.0%, the steps of heat treating the steel at a temperature of at least 500°C, and mechanically working the heat-treated steel under sufficient strain deformation to form an iron grain matrix with uniformly dispersed cementite in which said iron grain has an equiaxed configuration and an average grain size no greater than about 10 microns, and the predominant portion of said cementite is spheroidized.

12. A method as in claim 11 in which the steel is mechanically worked in a temperature range from 500°C to the gamma-cementite range.

13. A method as in claim 11 in which the steel is mechanically worked in the gamma-cementite range.

14. A method as in claim 11 together with the step of homogenizing the steel at elevated temperatures prior to mechanical working.

15. A method as in claim 11 in which the homogenizing step is performed in the gamma range.

16. A method as in claim 11 in which the heat treatment comprises tempering the steel and mechanical working is performed at cold temperatures.

17. In a method for treating an ultra high carbon steel having a carbon content of at least 1.0%, the steps of a. heating the steel to a temperature in excess of the alpha-gamma transformation line,
b. quenching the heated steel to form martensite,
c. tempering the martensite steel, and
d. mechanically working the steel under sufficient strain deformation to form an iron grain matrix with uniformly dispersed cementite in which said iron grain has an equiaxed configuration and an average grain size no greater than about 10 microns, and the predominant portion of said cementite is spheroidized.

18. A method for treating an ultra high carbon steel having a carbon content of at least 1% comprising the steps of cyclically heating and cooling the steel through the alpha-gamma iron transition line until sufficient strain deformation is imparted to form an iron grain matrix with uniformly dispersed cementite, said iron grain being stabilized in a predominantly equiaxed configuration and having an average grain size no greater than about 10 microns, said cementite being in predominantly spheroidized form in a temperature range of 723°C to 900°C.

19. A method for preparing an ultra high carbon steel having a carbon content of at least 1% comprising the steps of intimately mixing iron of a size less than 10 microns with an iron-carbon alloy containing predominantly spheroidized cementite and pressing and sintering the mixture to form an iron grain matrix with uniformly dispersed cementite, said iron being stabilized in a predominantly equiaxed configuration and having an average grain size no greater than about 10 microns, said cementite being in predominantly spheroidized form in a temperature range of 723°C to 900°C.

20. A method as in claim 19 in which commercial steel impurities including manganese are supplied in either the iron or iron-carbon alloy.

* * * * *